US010753599B1

(12) United States Patent
Hsu

(10) Patent No.: US 10,753,599 B1
(45) Date of Patent: Aug. 25, 2020

(54) MULTIFUNCTIONAL LAMP THAT IS ADAPTED TO FUNCTION AS ACOUSTICS LAMP AND GROUND INSERT LAMP

(71) Applicant: Dong Guan Jia Sheng Lighting Technology Co., Ltd. China, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/661,454

(22) Filed: Oct. 23, 2019

(51) Int. Cl.

| | |
|---|---|
| ***F21V 33/00*** | (2006.01) |
| ***F21V 21/08*** | (2006.01) |
| ***F21S 8/08*** | (2006.01) |
| ***H04R 1/02*** | (2006.01) |
| ***F21W 131/10*** | (2006.01) |

(52) U.S. Cl.
CPC ..... *F21V 33/0056* (2013.01); *F21S 8/081* (2013.01); *F21V 21/0824* (2013.01); *H04R 1/028* (2013.01); *F21W 2131/10* (2013.01)

(58) Field of Classification Search
CPC ..... F21S 8/081; F21S 8/083; F21V 33/0056; H04R 1/028
See application file for complete search history.

(56) References Cited

U.S. PATENT DOCUMENTS 6,345,685 B1 * 2/2002 Wells ..... H04R 1/028 181/153
9,920,888 B1 * 3/2018 Springer ..... F21K 9/235
2007/0109763 A1 * 5/2007 Wolf ..... H05B 47/105 362/86
2007/0171082 A1 * 7/2007 Melnik ..... F21L 4/005 340/574
2009/0034778 A1 * 2/2009 Chi ..... H04R 1/028 381/394
2011/0317861 A1 * 12/2011 Haase ..... F21V 33/0056 381/333
2013/0142372 A1 * 6/2013 Harwood ..... H04R 1/028 381/334
2014/0064521 A1 * 3/2014 Aggrawal ..... H04S 7/302 381/120
2015/0103520 A1 * 4/2015 Fournier ..... F21V 33/0056 362/190
2015/0292731 A1 * 10/2015 Rutger ..... F21V 33/0056 362/86
2015/0300581 A1 * 10/2015 Huang ..... F21V 33/0056 362/86
2017/0311062 A1 * 10/2017 Garrett ..... H04R 1/025
(Continued)

*Primary Examiner* — Alexander K Garlen
(74) *Attorney, Agent, or Firm* — Alan D. Kamrath; Mayer & Williams PC

(57) ABSTRACT

An acoustics lamp includes a lamp body, a hanging member pivotally mounted on an end portion of the lamp body, an illuminating device mounted in the lamp body, a sound device mounted in the lamp body, and a control device mounted in the lamp body. The illuminating device is electrically connected with the control device. The sound device is electrically connected with the control device. The lamp body has a horn shape and includes a lampshade, an end cap, a connecting seat, an outer shell, a base, and a bottom cap module. The acoustics lamp is mounted on a ground insert by a positioning spring, to construct a ground insert lamp.

10 Claims, 6 Drawing Sheets

(56) References Cited

U.S. PATENT DOCUMENTS

| | | | | |
|---|---|---|---|---|
| 2018/0084622 | A1* | 3/2018 | Chen | H05B 47/11 |
| 2018/0106472 | A1* | 4/2018 | Wijaya | F21V 33/0056 |
| 2018/0135819 | A1* | 5/2018 | Grandadam | F21S 9/02 |
| 2018/0152776 | A1* | 5/2018 | Lee | F21V 33/0056 |

* cited by examiner

MULTIFUNCTIONAL LAMP THAT IS ADAPTED TO FUNCTION AS ACOUSTICS LAMP AND GROUND INSERT LAMP

BACKGROUND OF THE INVENTION

1. Field of the Invention

The present invention relates to a lighting apparatus and, more particularly, to an acoustics lamp.

2. Description of the Related Art

A conventional lamp comprises a mounting seat, and a light source mounted on the mounting seat. Thus, the lamp provides an illuminating function. The conventional lamp is placed on the table only, is hung on the wall only, or secured on a fixed place only. However, the conventional lamp cannot be adapted to be placed on the table, hung on the wall, and secured on a fixed place simultaneously, thereby limiting the versatility of the conventional lamp. In addition, the conventional lamp only has a single function and cannot provide an audio function.

BRIEF SUMMARY OF THE INVENTION

An objective of the present invention is to provide a multifunctional lamp that is adapted to function as an acoustics lamp and a ground insert lamp.

Another objective of the present invention is to provide a multifunctional acoustics lamp available for multiple purposes.

In accordance with the present invention, there is provided an acoustics lamp comprising a lamp body, a hanging member mounted on an end portion of the lamp body, an illuminating device mounted in the lamp body, a sound device mounted in the lamp body, and a control device mounted in the lamp body. The illuminating device is electrically connected with the control device. The sound device is electrically connected with the control device. The lamp body has a horn shape and includes a lampshade, an end cap, a connecting seat, an outer shell, a base, and a bottom cap module. The connecting seat is located between the lampshade and the outer shell. The connecting seat is provided with a through hole. The base is mounted in the outer shell. The bottom cap module covers an open end face of the outer shell. The bottom cap module and the base form a receiving space, and the control device is mounted in the receiving space. The end cap is mounted on an end face of the lampshade. The hanging member is detachably mounted on the end cap. The sound device is mounted on the connecting seat and located in the lampshade. A sound output space is defined between the sound device, a top face of the base, and the outer shell. The outer shell is provided with a plurality of sound outlet holes connected to the sound output space. The sound device emits sound outward through the sound output space and the sound outlet hole.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
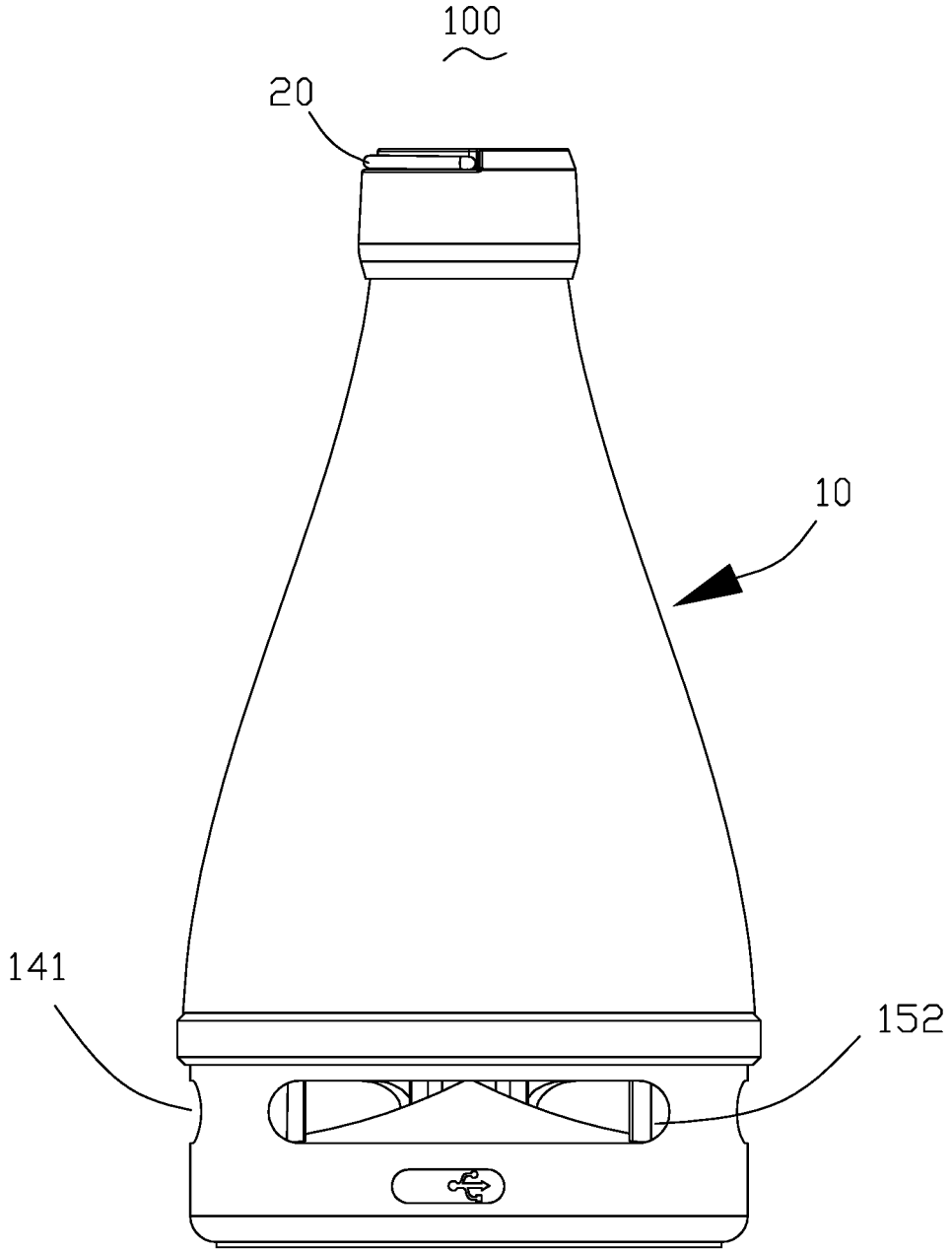
FIG. 1 is a front view of an acoustics lamp in accordance with the preferred embodiment of the present invention.
Figure 2:
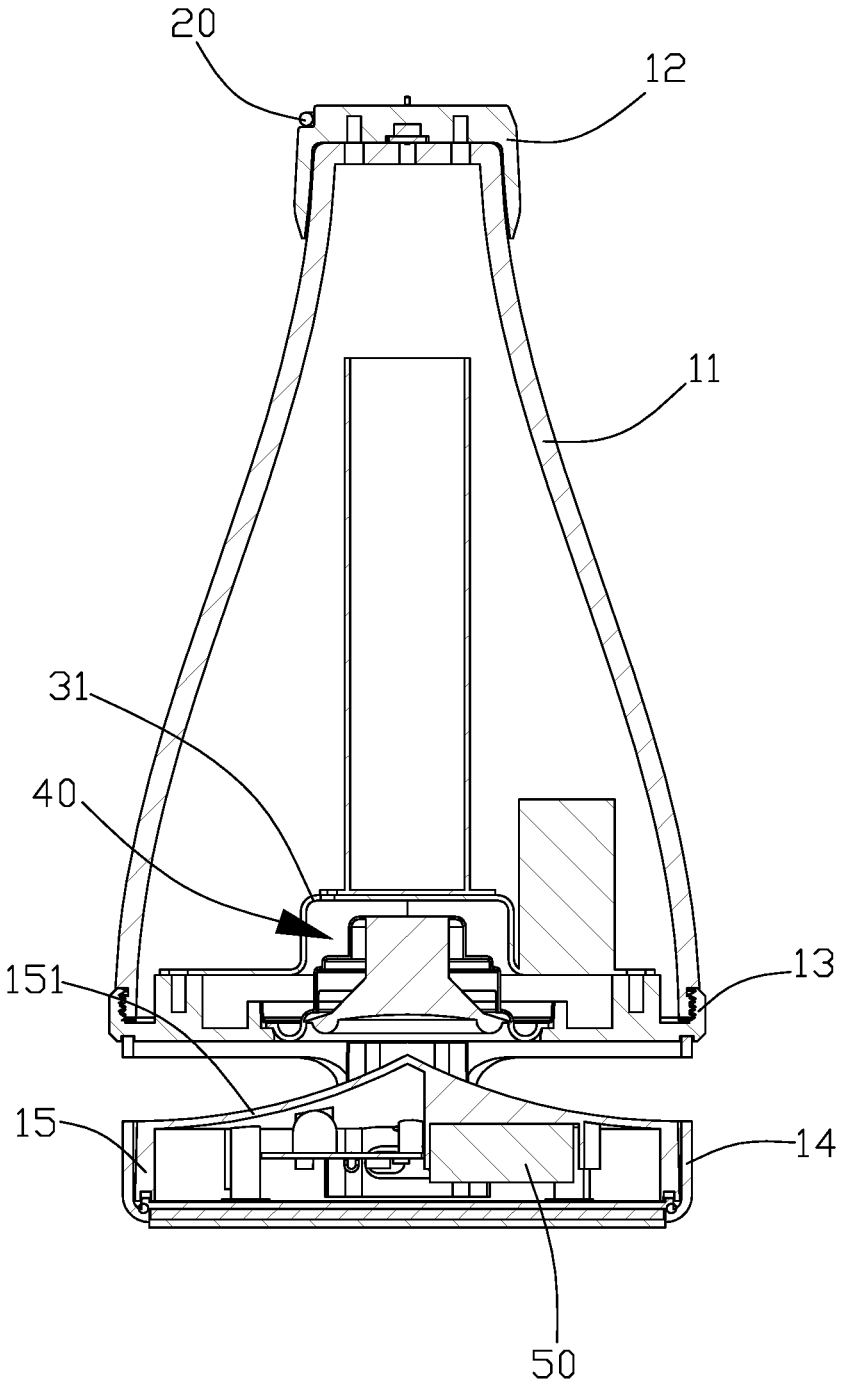
FIG. 2 is a cross-sectional view of the acoustics lamp in accordance with the preferred embodiment of the present invention.
Figure 3:
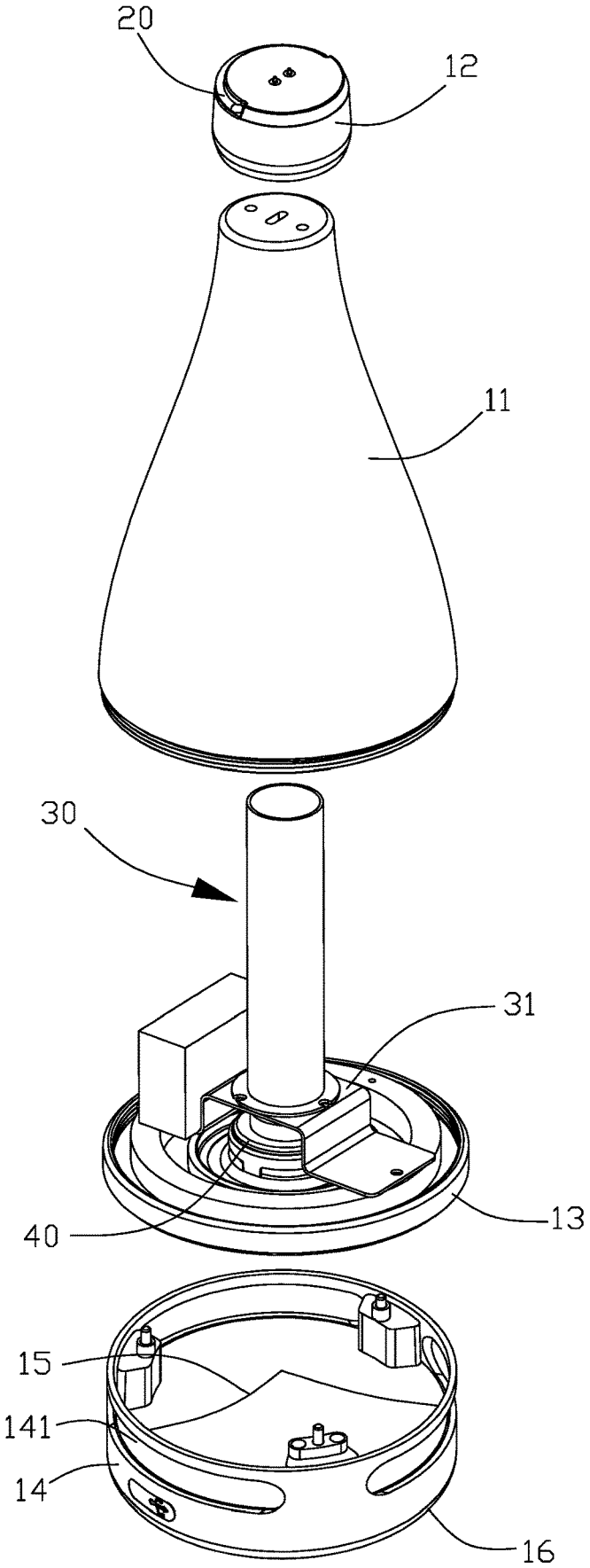
FIG. 3 is a partial exploded perspective view of the acoustics lamp in accordance with the preferred embodiment of the present invention.

Referring to the drawings and initially to FIGS. 1-3, an acoustics lamp 100 in accordance with the preferred embodiment of the present invention comprises a lamp body 10, a hanging member 20 mounted on an end portion of the lamp body 10, an illuminating device 30 mounted in the lamp body 10, a sound device 40 mounted in the lamp body 10, and a control device 50 mounted in the lamp body 10.

The illuminating device 30 is electrically connected with the control device 50. The sound device 40 is electrically connected with the control device 50. The control device 50 controls operation of the illuminating device 30 and the sound device 40.

The lamp body 10 has a horn shape and includes a lampshade 11, an end cap 12, a connecting seat 13, an outer shell 14, a base 15, and a bottom cap module 16. The connecting seat 13 is located between the lampshade 11 and the outer shell 14. The connecting seat 13 has a middle provided with a through hole. The base 15 is mounted in the outer shell 14. The bottom cap module 16 covers an open end face of the outer shell 14. The bottom cap module 16 and the base 15 form a receiving space, and the control device 50 is mounted in the receiving space. The end cap 12 is mounted on an end face of the lampshade 11. Preferably, the lampshade 11 is located between the end cap 12 and the connecting seat 13. The hanging member 20 is detachably mounted on the end cap 12. The sound device 40 is mounted on the connecting seat 13 and located in the lampshade 11. The sound device 40 has a speaker directed toward the through hole of the connecting seat 13. A sound output space is defined between the sound device 40, a top face of the base 15, and the outer shell 14. The outer shell 14 is locked on an end face of the connecting seat 13. The outer shell 14 is provided with a plurality of sound outlet holes 141 connected to the sound output space. The sound device 40 emits sound outward through the sound output space and the sound outlet hole 141.

In the preferred embodiment of the present invention, the hanging member 20 has a C-shaped configuration. The end cap 12 is provided with an arcuate groove, and the hanging member 20 is pivotally mounted in the arcuate groove of the end cap 12. Thus, the hanging member 20 is rotatable relative to the end cap 12. Preferably, the arcuate groove of the end cap 12 has two ends each provided with a mounting hole, and the hanging member 20 has two ends each provided with a projection inserted into the mounting hole of the end cap 12.

In the preferred embodiment of the present invention, the illuminating device 30 includes a restriction member 31 mounted on the connecting seat 13, and the sound device 40 is located between the restriction member 31 and the connecting seat 13. The restriction member 31 is used for installing the illuminating device 30, and is used for retaining the sound device 40.

In the preferred embodiment of the present invention, the base 15 is provided with a voice guide face 151 that is distant from the bottom cap module 16 and is directed toward the sound device 40. The voice guide face 151 rises from a periphery toward a central position thereof, and has a pointed portion formed on the central position thereof. The speaker of the sound device 40 aligns with the voice guide face 151 which diffuses the sound emitted from the speaker of the sound device 40.

In the preferred embodiment of the present invention, the base 15 has an end face provided with a plurality of guide posts 152 located outside of the voice guide face 151. The guide posts 152 are connected with and locked on the connecting seat 13, such that the base 15 and the connecting seat 13 combined together. The sound output space is defined between the connecting seat 13, the voice guide face 151, and the outer shell 14.

In the preferred embodiment of the present invention, the control device 50 includes a wireless module which is connected with a movable terminal. The movable terminal is provided with a regulating module connected with the wireless module.

In practice, the wireless module is connected to the APP of a cell phone. Thus, the user controls operation of the illuminating device 30 by the APP of the cell phone, to turn on/off the illuminating device 30, and to regulate the brightness and color temperature of the illuminating device 30. In addition, the audio signal of the APP of the cell phone is transmitted by the Bluetooth to the sound device 40, so as to play the audio signal and to control the volume. In use, the acoustics lamp 100 is placed on a table or plane. Alternatively, the acoustics lamp 100 is hung on a wall. Alternatively, the acoustics lamp 100 is directly held and carried by the user.

In the preferred embodiment of the present invention, the control device 50 includes a battery supplying an electric energy to the illuminating device 30 and the sound device 40.

In the preferred embodiment of the present invention, the illuminating device 30 is mounted on the connecting seat 13 by fasteners and located above the sound device 40.

In the preferred embodiment of the present invention, the illuminating device 30 is removed from the connecting seat 13, and is used individually. Similarly, the sound device 40 is removed from the connecting seat 13, and is used individually.

In practice, a plurality of sound devices 40 are operated in combination. The sound devices 40 are connected to construct a combination sound system. The sound devices 40 include a main frame (or main engine) and an auxiliary frame (or auxiliary engine). The auxiliary frame receives an input audio signal from the main frame, decodes the input audio signal into an output audio signal, and transmits the output audio signal to a speaker which emits voice. The sound devices 40 transmit the audio signal by Bluetooth, 2.4G, WiFi or FM.

Figure 4:
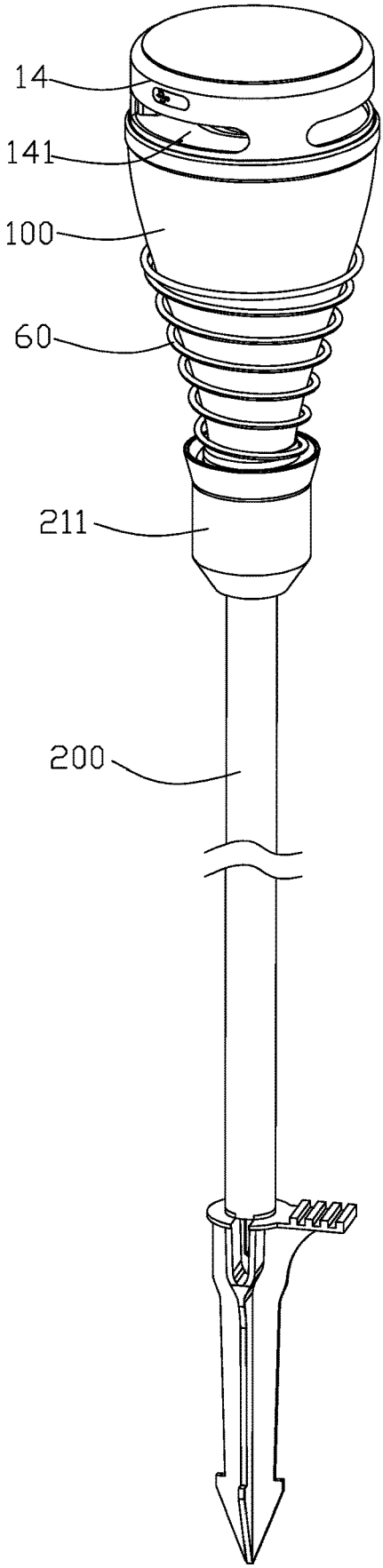
FIG. 4 is a perspective view of a combination of the acoustics lamp and a ground insert in accordance with the preferred embodiment of the present invention.
Figure 5:
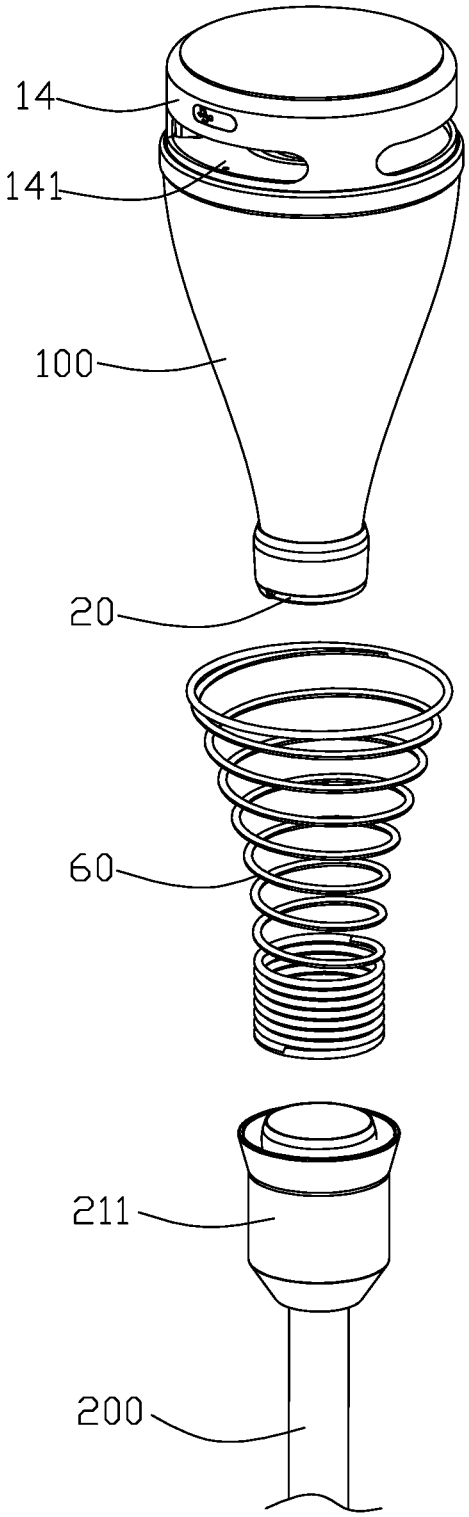
FIG. 5 is a partial exploded perspective view of the combination of the acoustics lamp and a ground insert in accordance with the preferred embodiment of the present invention.
Figure 6:
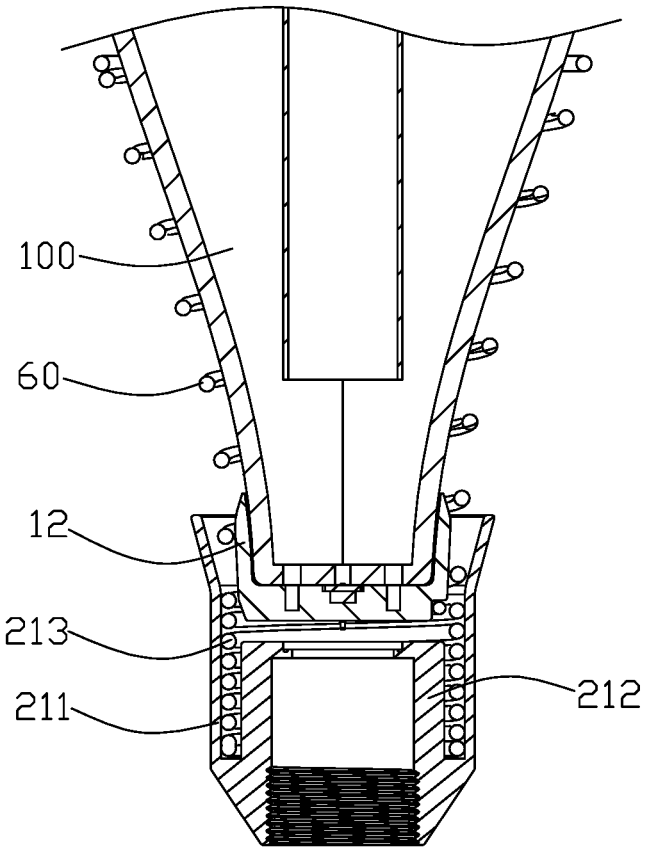
FIG. 6 is a partial cross-sectional view of the combination of the acoustics lamp and a ground insert in accordance with the preferred embodiment of the present invention.

Referring to FIGS. 4-6, the acoustics lamp 100 is mounted on a ground insert 200 by a positioning spring 60, to construct a ground insert lamp. The ground insert 200 has a top provided with a mounting portion 211. The positioning spring 60 is mounted in and protrudes outward from the mounting portion 211 of the ground insert 200. The acoustics lamp 100 is mounted in the positioning spring 60, and has a bottom contacting a top of the mounting portion 211.

In the preferred embodiment of the present invention, the positioning spring 60 has a horn shape and has a diameter that is increased gradually from bottom to top. The positioning spring 60 has a shape and a dimension matching that of the acoustics lamp 100.

In the preferred embodiment of the present invention, the top of the mounting portion 211 is provided with a charging device 212, and a mounting recess 213 is formed between the charging device 212 and an inner wall of the mounting portion 211. The positioning spring 60 has a reduced first portion mounted in the mounting recess 213 and an enlarged second portion protruding from the mounting portion 211.

In the preferred embodiment of the present invention, the end cap 12 of the acoustics lamp 100 is mounted in the positioning spring 60 and has a bottom contacting a top of the charging device 212. Thus, the charging device 212 charges the acoustics lamp 100 by a charging plug or by a wireless transmission.

Accordingly, the acoustics lamp 100 has multiple functions to enhance the versatility thereof. In addition, the acoustics lamp 100 is used indoors and outdoors. Further, the acoustics lamp 100 is placed on a determined place, is hung on the wall, is directly held and carried by the user, and is secured on the ground insert 200.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An acoustics lamp comprising:

a lamp body;

a hanging member mounted on an end portion of the lamp body;

an illuminating device mounted in the lamp body;

a sound device mounted in the lamp body; and a control device mounted in the lamp body;

wherein:

the illuminating device is electrically connected with the control device;

the sound device is electrically connected with the control device;

the lamp body has a horn shape and includes a lampshade, an end cap, a connecting seat, an outer shell, a base, and a bottom cap module;

the connecting seat is located between the lampshade and the outer shell;

the connecting seat is provided with a through hole;

the base is mounted in the outer shell;

the bottom cap module covers an open end face of the outer shell;

the bottom cap module and the base form a receiving space, and the control device is mounted in the receiving space;

the end cap is mounted on an end face of the lampshade;

the hanging member is detachably mounted on the end cap;

the sound device is mounted on the connecting seat and located in the lampshade;

a sound output space is defined between the sound device, a top face of the base, and the outer shell;

the outer shell is provided with a plurality of sound outlet holes connected to the sound output space; and the sound device emits sound outward through the sound output space and the sound outlet hole.

2. The acoustics lamp of claim 1, wherein:

the hanging member has a C-shaped configuration;

the end cap is provided with an arcuate groove;

the hanging member is pivotally mounted in the arcuate groove of the end cap; and the hanging member is rotatable relative to the end cap.

3. The acoustics lamp of claim 1, wherein the illuminating device includes a restriction member mounted on the connecting seat, and the sound device is located between the restriction member and the connecting seat.

4. The acoustics lamp of claim 1, wherein the base is provided with a voice guide face that is distant from the bottom cap module and is directed toward the sound device, and the voice guide face rises from a periphery toward a central position thereof, and has a pointed portion formed on the central position thereof.

5. The acoustics lamp of claim 4, wherein:

the base has an end face provided with a plurality of guide posts located outside of the voice guide face;

the guide posts are connected with the connecting seat; and the sound output space is defined between the connecting seat, the voice guide face, and the outer shell.

6. The acoustics lamp of claim 1, wherein the control device includes a wireless module connected with a movable terminal, and the movable terminal is provided with a regulating module connected with the wireless module.

7. The acoustics lamp of claim 1, wherein:

the acoustics lamp is mounted on a ground insert by a positioning spring, to construct a ground insert lamp;

the ground insert has a top provided with a mounting portion;

the positioning spring is mounted in and protrudes outward from the mounting portion of the ground insert; and the acoustics lamp is mounted in the positioning spring, and has a bottom contacting a top of the mounting portion.

8. The acoustics lamp of claim 7, wherein:

the positioning spring has a horn shape and has a diameter that is increased gradually from bottom to top; and the positioning spring has a shape and a dimension matching that of the acoustics lamp.

9. The acoustics lamp of claim 8, wherein:

the top of the mounting portion is provided with a charging device;

a mounting recess is formed between the charging device and an inner wall of the mounting portion; and the positioning spring has a reduced first portion mounted in the mounting recess and an enlarged second portion protruding from the mounting portion.

10. The acoustics lamp of claim 8, wherein:

the end cap of the acoustics lamp is mounted in the positioning spring and has a bottom contacting a top of the charging device; and the charging device charges the acoustics lamp.

* * * * *